US006441353B1

(12) United States Patent
Gehrmann et al.

(10) Patent No.: US 6,441,353 B1
(45) Date of Patent: Aug. 27, 2002

(54) INTEGRATED ROLLER UNIT

(75) Inventors: Wolfgang Gehrmann; Max Brossmer, both of Hanau (DE)

(73) Assignee: D.I.E.N.E.S. Apparatebau GmbH, Mulheim (DE)

( * ) Notice: Subject to any disclaimer, the term of this patent is extended or adjusted under 35 U.S.C. 154(b) by 0 days.

(21) Appl. No.: 09/555,112

(22) PCT Filed: Sep. 20, 1999

(86) PCT No.: PCT/EP99/06944

§ 371 (c)(1),
(2), (4) Date: Jun. 13, 2000

(87) PCT Pub. No.: WO00/19586

PCT Pub. Date: Apr. 6, 2000

(30) Foreign Application Priority Data

Sep. 25, 1998 (DE) ..... 198 43 990

(51) Int. Cl.[7] ..... H05B 6/14; H05B 6/42

(52) U.S. Cl. ..... 219/619; 219/632; 219/647; 219/667; 219/677; 226/188

(58) Field of Search ..... 219/619, 632, 219/647, 652, 651, 660, 661, 665, 667, 672, 677, 469; 226/188

(56) References Cited

U.S. PATENT DOCUMENTS 3,200,230 A * 8/1965 Bretoniere ..... 219/619
5,235,151 A * 8/1993 Erdmann ..... 219/619
5,324,905 A * 6/1994 Arnosti et al. ..... 219/619
5,624,593 A * 4/1997 Martens ..... 219/619
5,714,816 A 2/1998 Jensen
5,954,258 A 9/1999 Baader

FOREIGN PATENT DOCUMENTS

| | | |
|---|---|---|
| DE | 196 36 723 A1 | 3/1997 |
| DE | 197 26 258 A1 | 1/1998 |
| DE | 198 43 990 C1 | 8/1999 |
| EP | 0 235 505 | 9/1987 |
| EP | 0 424 867 A1 | 5/1991 |
| EP | 0 681 360 A2 | 11/1995 |
| GB | 2 167 608 | 5/1986 |

OTHER PUBLICATIONS

"Eins plus einsqleich eins", Production, No. 14, Apr. 2, 1998, p. 15.

* cited by examiner

*Primary Examiner*—Philip H. Leung
(74) *Attorney, Agent, or Firm*—Herbert Dubno

(57) ABSTRACT

The invention relates to roller unit consisting of an inductively heated roller, a drive motor, an inductor and a frequency converter. According to the invention not only the converter but also the temperature regulator for the induction heater and monitoring devices for the roller, heater and/or motor are integrated into the roller unit. The power electronics and the regulator are mounted on a common cooling unit which is cooled by a coolant which at the same time also cools the motor, the bearings and the inductor.

31 Claims, 2 Drawing Sheets

INTEGRATED ROLLER UNIT

CROSS REFERENCE TO RELATED APPLICATIONS

This application is a national stage of PCT/EP 99/069,44 filed Sep. 20, 1999 and based upon German National application 198 43 990.3 of Sep. 20, 1998 under the International Convention.

FIELD OF THE INVENTION

The present invention relates to an inductively-heated gallet or godet for the treatment of synthetic fibers or yarns and is directed to a structure which is simultaneously advantageous for installation, set-up, operation and maintenance. It should be noted that a textile machine usually has a multiplicity of such godets which are supplied with operating parameters by a control computer for speed and temperature.

BACKGROUND OF THE INVENTION

From EP 0 235 505 B1 and EP 0 424 867 B1 it is known to cool the motor, inductor and bearings of inductively heated godets with air or liquid. For numerous industrial purposes, so-called integral motors comprised of a motor and frequency converter have been provided (compare Journal "PRODUKTION" of April 2 1998, No. 14, page 15). A blower cooling for a godet unit, motor and converter is described in DE 197 26 258 A1 where the frequency converter is encapsulated in a housing in a heat transfer state in which, for heat dissipation, the surface provided with cooling ribs is cooled by a blower. For this purpose, the converter housing is provided with a common axis with the motor and on the opposite side of the motor from that of the godet in a cup-shaped godet housing which also encloses the motor and in whose bottom region a blower impeller separately driven by a fan motor displaces cooling air initially over the converter housing and then over the godet motor.

SUMMARY OF THE INVENTION

A godet assembly according to the invention can be affixed on a machine frame of a yarn processing apparatus and is provided with an inductively heatable godet and a drive motor, whereby a frequency converter for the motor, a controller serving as a temperature regulator for the heater as well as monitoring devices for the godet for the heater and/or for the motor are integrated in the godet assembly.

With the invention, a compact and integrated godet assembly is obtained which is especially suitable both for high thread load (thermal loading) and high speed. The important advantage of the assembly of godet, frequency converter/drive, temperature regulator and monitor device to an integrated unit resides in that no separately conditioned space is required as the control and circuitry closet and the cabling costs are sharply reduced. The overall unit, i.e. the mechanics of the motor drive as well as the heat control, is completely testable before it is installed in the textile machine so that long start-up times of the machine and possible installation defects are avoided. In case a unit replacement is required, the production fall-out time is significantly reduced because the replacement unit can be fully tested mechanically and electrically before installation. Environmental influences are largely excluded because of the compact construction of the electronic circuitry in the unit itself and the suitable cooling thereof. In addition, the incorporation of the electronic circuitry directly in the unit allows the measurement and monitoring of additional physical and electrical parameters without requiring therefore expensive cabling. The electromagnetic inertia of the overall system is significantly improved because of the compact construction and the short cables.

The frequency converter, the controller and the monitoring circuitry can be incorporated in a sealed housing which is directly affixed to the godet unit and is electrically connected with it. As the single electrical connection to the exterior, an alternating current terminal for the heating power, a direct current terminal for the converter as well as a data base terminal to a computer can be provided. The godet assembly can have air cooling of the power circuitry. The power circuitry and the controller can be mounted on a heat conductive cooling block which is well conducting and which is in good heat conducting relationship with an outer protective housing. The preferably cylindrical protective housing can be provided with axial cooling ribs. The blower can be arranged as a cooling blower in the axial direction of motor and godet between the drive motor and the cooling block. The blower roller can be affixed to the godet. The godet assembly can also have liquid cooling, the converter and controller are carried by a hollow liquid cooled cooling block. In the axial direction of the motor shaft between the cooling block and godet holder or support flange the motor housing is provided with coolant passages or a coolant annular gap. Further coolant passages can be provided for cooling the shaft bearing. In the inductively heated godet, additional coolant passages and spaces can be provided in the region of the heating inductor and/or the hub of the godet. A bearing housing carrying at least the bearing remote from the motor and can extend into the godet shell and the inductor. The bearing remote from the motor can be located approximately at the center of gravity of the godet. The configuration of the cooling passages is such that the cooling liquid initially flows through the cooling block, then through the motor cooling passages and then through an annular space surrounding the godet hub and then through a cooling passage for the bearing and inductor before it flows to the coolant outlet. The components of the converter can be mounted on a cover plate and the components of the controller can be mounted on the opposite cover plate of a hollow substantially rectangular cooling block. The cooling block can be affixed to the end wall furthest from the godet of the motor housing. Between the cooling block and the wall or ring plate carrying same, a thermal and/or mechanical insulating intermediate layer is provided. The cooling block can be surrounded by a sealed protective hood. The assembly two spaced-apart shaft bearings, and the shaft bearing furthest from the motor is disposed within the integrator and is carried by a bearing housing surrounding shaft, while a support flange which serves to affix the unit on the machine frame extends into the interior of the integrator. The bearing housing can serve simultaneously to support the integrator. The inductor can be comprised of an inductor support tube held by the support flange, an inductor core preferably of electromagnetic sheet surrounding the support tube and an exciting winding on the inductor core.

The inductor support tube and the bearing housing there is an annular gap which is sealed in axial direction on both sides by elastic sealing rings which simultaneously serve as vibration damping between the inductor and the bearing housing. A bearing temperature sensor can be arranged in the region of the bearing furthest from the motor. One of the bearings can be located in the region of the support flange. An asynchronous drive motor which can be used and can be controlled by the controller taking into consideration the slip frequency of the drive motor for simultaneously synchronous speed regulation. The transmission of temperature measurement signals from the godet to the controller is effected by a rotating measuring value transmitter serving as a pulse generator for signals serving for speed regulation. The controller can measure the torque by the slip of the asynchronous motor and thus determines the thread tension.

The monitoring device can monitor, in addition to the godet temperatures, the bearing temperatures and the inductor temperatures also other physical and/or electrical magnitudes like vibration, cooling water and motor temperature, motor current and supplies warning or safety shutdown signals derived therefrom.

A common cooling of the electronic power circuitry, motor, bearings and other parts of the unit, e.g. the inductor, can be carried out in a manner known per se (compare EP 0 424 867) with intrinsic or external ventilation. For this purpose preferably a carrier or cooling body enclosed by a cylindrical housing or housing part is connected to the blower and is constructed to receive the power electronic circuitry and the controller such that this electronic housing lies on the suction side of the blower and the motor as well as its bearing lie on its pressure side. The blower impeller can either be driven by the godet motor (intrinsic ventilation) or by a separate fan motor (external ventilation).

The cooling by means of a cooling liquid, for example, the cold water of a coolant unit, enables cooling of the power electronic circuitry and the controller independently of ambient temperature and the intrinsic heating of the unit. With liquid cooling the godet motor requires no additional drive power for the blower. A common cold water supply for the electronic power circuitry, motor and bearing has a single cold water connection for the unit.

BRIEF DESCRIPTION OF THE DRAWING

The invention is described below in greater detail with reference to two embodiments illustrated in the drawing. It shows in FIG. 1 a godet unit with water cooling in sections along the godet and motor axis.

SPECIFIC DESCRIPTION

A yarn processing machine is usually equipped with a multiplicity of such godet units which are supplied via a bus from a control computer with feed signals and temperature signals as well as with current supply lines with current for the motor and heater.

Figure 1:
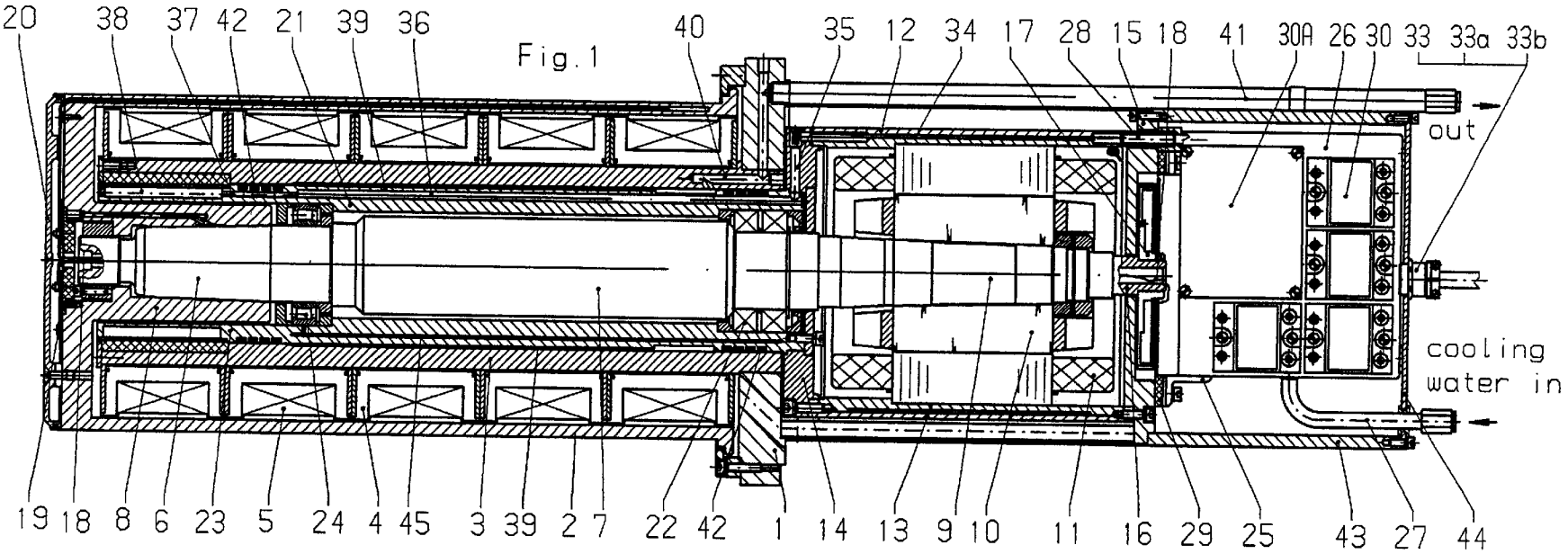
Figure 3:
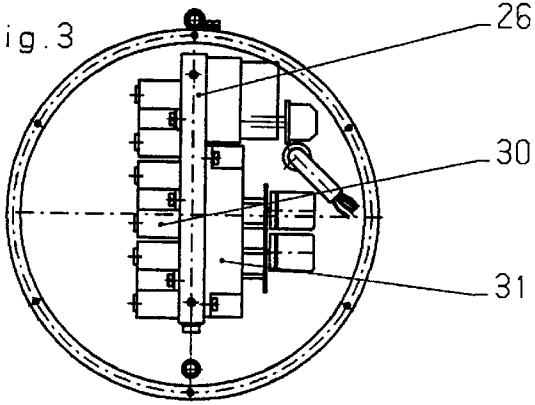
FIG. 3 an elevation of the back side of the unit with cover removed so that the cooling block with the power electronic circuitry and controller is visible.
Figure 2:
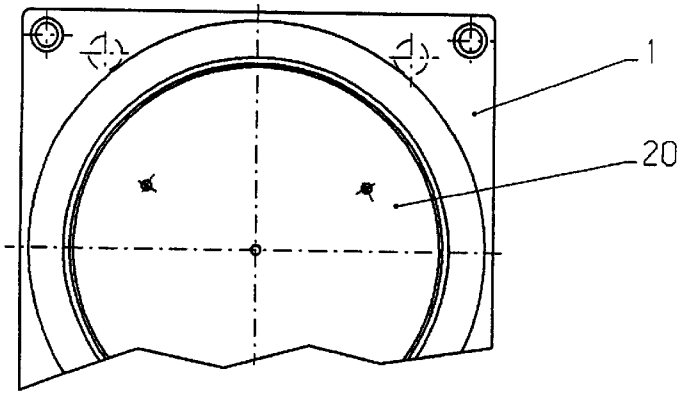
FIG. 2 an elevation of the godet end.

In the case of the godet unit illustrated in FIGS. 1 to 3 with water cooling, the cold water fittings are connected with self-sealing junctions for example to the cold water network of a coolant apparatus or to a separate cooler. A support flange 1 affixed to the machine frame holds a tube piece 21 extending into the godet shell 2 and the inductor. The illustrated multizone inductor here comprises a support tube 3, a core 4 preferably of electromagnetic sheet and the exciting coils 5. The tube piece 21 serves on the one hand as a bearing housing for supporting the two bearings 22 and 24. In that case, the bearing 22 close to the motor is located in the region of the support flange 1 while the bearing 24 remote from the motor lies proximally at the center of gravity of the godet and is held by the end region 23 of the bearing housing 21 remote from the flange. On the other hand, the tube piece 21 supports the inductor carrying the tube 3. The latter is braced via sealing ring 42 and thus also an elastic element against the flange on the bearing housing 21 and forms between itself and the inductor carrying tube 3 a hollow space which serves for cooling purposes. The illustrated configuration of the mounting of the shaft and inductor results in a mechanical decoupling between the inductor carrying tube and bearing housing 21 so that on the one hand mechanical vibration resulting from an electrical excitation of the inductor is not transferred to the shaft bearing and on the other hand, vibrations resulting from eccentricity of the rotating parts, shaft/godet, are not transferred to the inductor. By suitable choice of the spring constants and the number of O-rings 42, one can influence the characteristic resonance frequency of the unit.

On the free end 6 of the drive shaft 7 is seated the hub of the godet whose shell 2 is connected with the shaft 7. The other end part 9 of the shaft 7 carries the rotor 10 of the motor whose stator 11 and housing 12 are also affixed on the support flange 1. The motor housing 12 is thus comprised of a hollow cylindrical shell 13 and two ring plates 14 and 15 at its ends. The ring plate 14 proximal to the flange is provided with a screw connection with the carrying flange 1. At the shaft end 16 extending through the ring plate 15 remote from the flange has a rotating part 17 of a measured value transmitter attached thereto and whose stationary part is held on the ring plate 15. From the rotating part 17 conductors 18 extend through the hollow shaft 7 to an insulated sensor terminal plate 19 and from there to temperature sensors which are embedded in bores of the godet shell 2. The sensor terminal plate 19 is closed toward the exterior with a cover 20 which has conductor tracks thereon and protects the end of the device.

In the embodiment of water cooling according to FIGS. 1 to 3, on the ring plate 15 remote from the flange, a cooling block 26 is mounted via an angle piece 25, the cooling block having a coolant inlet 27 and a coolant outlet 28. An intermediate layer 29 insulates the angle piece 25 and thus the cooling block 26 from vibration and thermally from ring plate 15 and thus from the motor. The cooling block 26 in this embodiment is illustrated as a rectangular hollow body which, in its interior can be subdivided by flow guide means into a multiplicity of channels in the cooling block longitudinally extending in, for example, the flow direction. As FIG. 3 shows on one cover plate of the cooling block 26 the power semiconductor 30 is mounted with a microcomputer 30A as well as the usual assembly of converters while on the opposite cover plate the components 31 of the controller for the godet unit can be fastened in good conducting relationship so that frequency converter and controller are thermally decoupled. This ensures a temperature independent operation of the controller. The output of the converter is connected via a cable 32 with the exciting coils 5 of the inductor. The controller 31 controls on the one hand via the converter 39, 30A the heating power supplied to the inductor and on the other hand the speed of the motor. For this purpose it receives the supply alternating voltage via the supply cable 33 for the heater 4, 5, via a cable 33A the direct current for the converter 30, 30A and via a bus 33B the control parameters for the controller in the form of temperature and speed signals from the computer associated with the machine. The bearing 24 remote from the motor is provided on its inner and/or outer ring with temperature sensor 45 whose output signal is used by controller 31 to so control the amount of the cooling medium by means of an electrical control valve for all operating states of the unit with both the absolute bearing temperature and also the temperature difference between critical values predetermined between the inner and outer ring will not be exceeded. By the use of an asynchronous motor, the controller 31 also assumes synchronous speed regulation in that it can monitor the slip frequency of the motor for the control of the converter 30, 30A. For this purpose, the measured value transmitter 17 can additionally be provided with a pulse generator whose output signal is used for speed regulation. The controller 31 can detect in addition, the slip of the asynchronous motor and thus the torque, i.e. the thread tension. Finally, with the controller or a monitoring device associated therewith, still other physical and electrical parameters, like vibration, cooling water temperature, motor temperature, motor current or the like can be detected. Aside from the godet temperature, the bearing temperatures and the inductor temperature and warning signals or safety shutdown signals can be provided. After the coolant supplied through the coolant inlet 27, preferably cold water through the cooling inlet 27 has passed through the cooling block 26, it leaves through the outlet 28 and cooling passage 34 or an annular gap 34 in the motor housing 12 so that an effective liquid cooling of the motor is assured. Then the cooling water flows through the passage 35 and the passages 36 and 37 in the bearing housing 21 to the front annular chamber 38 surrounding the hub 8. The passages 36 are uniformly distributed over the periphery of the bearing housing 21 to cool in this manner the outer ring of the bearings 22 and 24. From the annular space 38 the now already warm cooling water passes through a connecting passage not shown into the annular gap 39 between the bearing housing 21 and the inductor support tube 3. Finally, a passage 40 connects this annular space 39 with the cold water return line 41. The cold water supplied by a single cold water supply line 27 thus cools in the following sequence the individual components of the assembly: power electronic circuitry 30 and controller 31, motor 9-15, the hub 8 of the godet, the bearing 22, the inductor 3, 4, 5 and finally the bearing 24. As a result, the cooling of the entire unit is unusually effective, whereby the components requiring the greatest cooling (the power electronic circuitry) lies at the start of the cooling chain. A protective hood comprised of a cylindrical shell 43 and a common wall 44 surrounds the cooling block 26 and is provided with sealed throughgoing openings for the cable connectors 33, 33A and 33B as well as for the cold water supply line 27. These connectors are preferably configured as plug connectors. As FIG. 1 shows, the bearing housing 21 has a longitudinal bore 44A which extends from the flange 1 up to the outer ring of the bearing 24 and which receives a temperature sensor 45 for measuring the temperature of this bearing. The cold water supply is so controlled by the controller 31 and a cold water metering valve that with every conceivable operating mode, no bearing overheating can arise and also there is no impermissible high temperature difference between the inner and outer ring of the bearing 24.

Figure 4:
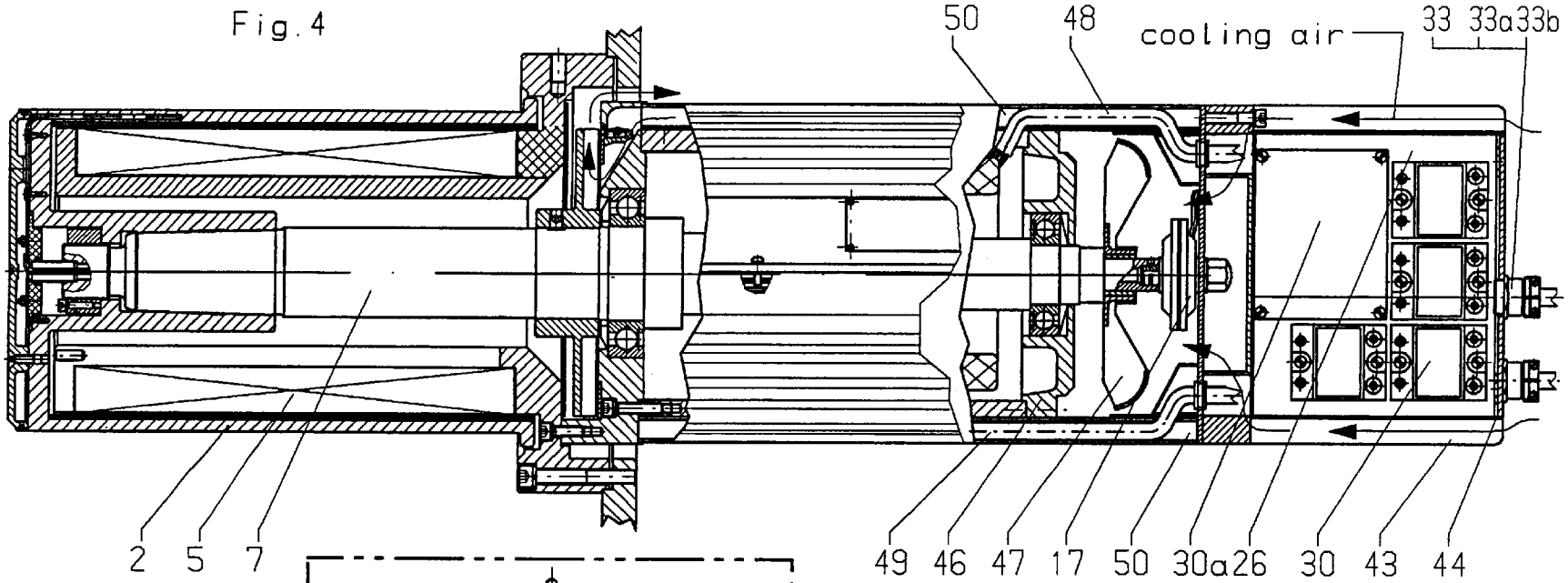
FIG. 4 a godet unit with air cooling in the form of intrinsic ventilation in section along the godet and motor axis.
Figure 5:
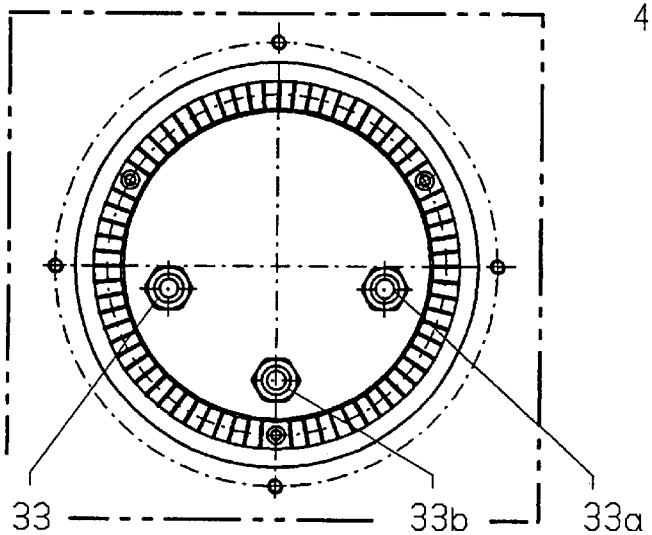
FIG. 5 a plan view of the end of the godet housing turned away from the godet.

The second embodiment illustrated in FIGS. 4 and 5 of the integrated godet unit operates with air cooling and, indeed, with intrinsic ventilation. The mechanical construction of the godet and motor as well as the cooling air flow along the motor and in the region of the flange-side bearing, corresponding substantially to that of the arrangement in EP 0424 867 B1 and thus need not be described again in detail. On the shaft end of the motor projecting out of the bearing shield 46, there are provided in succession the fan 47 and the rotating part 17 of the measured value transmitter. On one side of a cooling block 26 which is of good thermal conductivity or on a separate suitable carrier are mounted the power electronic circuitry 30 and the microcomputer 30A. The components of the controller 31 are mounted for example on the opposite side. A cylindrical shell 43 provided with axial cooling ribs, forms together the end wall 44 a protective hood which encloses the cooling block 26 serving as the circuitry carrier and is in good thermal contact therewith so that the cooling air sucked by the fan passes for example outwardly along the cooling ribs or between the latter or between the latter and an outer housing shell so that the cooling air passes initially to cool the circuitry before it is forced into the cooling passages of the motor housing and then passes in the vicinity of the support flange along the bearing 24 proximal to the godet. The current supply lines 48 for the motor and the heating current lines 49 for the inductor run at least partly in respective cooling longitudinal channels 50 of which a multiplicity are provided in spaced relationship over the periphery of the motor.

What is claimed:

1. A godet assembly comprising:

support means for affixing said assembly to a machine frame of a yarn processing machine;

a godet having an inductively heatable shell;

a drive motor and a drive shaft connecting said godet to said motor;

bearings supporting said drive shaft;

an electronic frequency inverter for generating three-phase power for said motor;

a stationary induction heater for heating said godet shell;

an electronic heating power supply foresaid induction heater;

cooling means for cooling said motor, said frequency inverter, said electronic heating power supply and at least one of said bearings;

at least one first temperature sensor for sensing the temperature of said godet shell;

at least one second temperature sensor for sensing the temperature of one of said bearings;

a microcomputer operating as a feed-back controller for controlling the temperature of said godet by controlling the energy supply to said induction heater;

first terminal means for supplying a DC voltage to said frequency inverter;

second terminal means for supplying AC current to said induction heater; and third terminal means for connecting said microcomputer to a data bus leading to an external process computer, wherein said microcomputer further compares output signals of said first and second temperature sensors with predetermined limit signals and provides an alarm signal if one of said predetermined limits is exceeded.

2. The godet assembly of claim 1, comprising two of said second temperature sensors for sensing the temperatures of the inner and of the outer race of said bearing, wherein said microcomputer generates an alarm signal, if the temperature difference between the inner and the outer race exceeds a predetermined limit.

3. The godet assembly of claim 2, wherein said microcomputer operates as a feed-back controller for further controlling the temperature difference between the inner race and the outer race of said at least one bearing by controlling said cooling means.

4. The godet assembly of claim 1, comprising an asynchronous drive motor and a speed sensor for sensing the rotational speed of said shaft, wherein said microcomputer operates as a feed-back controller for further controlling the rotational speed of said godet shell by controlling the output frequency of said frequency inverter.

5. The godet assembly of claim 1, having said frequency inverter and said microcomputer incorporated into a sealed housing which is directly attached to the housing of said drive motor.

6. The godet assembly of claim 1, with air cooling of the power electronics of said frequency inverter, wherein said power electronics and said microcomputer are mounted on a heat conducting cooling block which is attached to a protective housing in good heat transfer contact.

7. The godet assembly of claim 6, wherein a blower wheel of a cooling blower, in axial direction of the drive shaft, is located between said drive motor and said cooling block.

8. The godet assembly of claim 7, wherein said blower wheel is fixed to said drive shaft.

9. The godet assembly of claim 37, comprising a blower motor driving said blower wheel.

10. The godet assembly of claim 6, wherein the power electronics of said frequency inverter are mounted on a first support surface of said cooling block and said microcomputer is mounted on a second support surface lying opposite said first support surface.

11. The godet assembly of claim 6, having said cooling block attached to that front wall of the motor housing which is remote from said godet.

12. The godet assembly of claim 6, comprising a thermally and/or mechanically insulating intermediate layer provided between said cooling block and its carrier.

13. The godet assembly of claim 6, comprising a sealed protective hood surrounding said cooling block.

14. The godet assembly of claim 1, wherein said protective housing is cylindrical and is provided with cooling ribs extending in axial direction.

15. The godet assembly of claim 1, with liquid cooling of the power electronics of said frequency inverter, wherein said power electronics and said microcomputer are carried by a hollow cooling block through which said cooling liquid flows.

16. The godet assembly of claim 15, wherein the housing of said drive motor, in axial direction of said drive shaft, is located between said cooling block and said support means and is provided with coolant channels or a circular coolant gap.

17. The godet assembly of claim 16, further comprising coolant channels for cooling said bearings.

18. The godet assembly of claim 16, further comprising additional coolant channels in or adjacent to said induction heater.

19. The godet assembly of claim 16, wherein said godet is fixed to an end of said drive shaft by means of a hub and further coolant channels are provided in the region of said hub.

20. The godet assembly of claim 10, having a system of cooling passages of such a configuration that the coolant initially flows through said cooling block, then through cooling passages around said drive motor, then through an annular space surrounding said hub and then through further cooling passages adjacent said induction heater and said bearings before it flows to the coolant outlet. the slip frequency of said drive motor, simultaneously achieves synchronous speed control of said drive motor.

21. The godet assembly of claim 15, further comprising a bearing housing carrying at least that bearing which is remote from said motor, wherein said bearing housing, at least partially, is surrounded by said induction heater.

22. The godet assembly of claim 15, having two spaced apart shaft bearings, wherein the shaft bearing further from said drive motor is disposed inside said induction heater and is carried by a tube-like bearing housing surrounding said drive shaft, with said bearing housing being supported by a support flange provided for attaching said godet assembly to the machine frame.

23. The godet assembly of claim 22, wherein said bearing housing simultaneously supports part of said induction heater.

24. The godet assembly of claim 23, wherein said induction heater comprises an inductor core which is carried by an inductor support tube which is attached to said support flange.

25. The godet assembly of claim 24, having a circular gap between said inductor support tube and said bearing housing, wherein said circular gap is sealed at both axial ends by resilient sealing means, which simultaneously provides vibration damping between said inductor core and said bearing housing.

26. The godet assembly of claim 23, wherein one of said bearings is located in the region of said support flange.

27. The godet assembly of claim 1, wherein the bearing remote from said drive motor is located approximately at the center of gravity of said assembly.

28. The godet assembly of claim 1, comprising an asynchronous drive motor, wherein said microcomputer, by evaluating the slip frequency of said drive motor, simultaneously achieves synchronous speed control of said drive motor.

29. The godet assembly of claim 28, wherein said microcomputer, for determining the draw force acting upon a yarn being advanced by said godet, measures a slip of said asynchronous drive motor and therewith measures its torque.

30. The godet assembly of claim 1, comprising a rotating measuring signal transmitter for transmitting temperature signals from said rotating first temperature sensor to the stationary microcomputer, dependent on the rotational speed of said drive shaft, which is used by said microcomputer for speed control of said drive motor.

31. The godet assembly of claim 1, wherein said microcomputer delivers electrical signals indicative of at least one further physical or electrical parameter of said godet, including vibrations, cooling water temperature, drive motor temperature, drive motor current and heater current, and supplies corresponding alarm or safety shut-down signals.

* * * * *